US006276630B1

(12) United States Patent
Mueller et al.

(10) Patent No.: US 6,276,630 B1
(45) Date of Patent: Aug. 21, 2001

(54) DEVICE FOR WINDING WEBS OF FABRIC

(75) Inventors: Armin Mueller, Stuttgart; Werner Engelfried, Sindelfingen, both of (DE)

(73) Assignee: Terrot Strickmaschinen GmbH, Stuttgart (DE)

( * ) Notice: Subject to any disclaimer, the term of this patent is extended or adjusted under 35 U.S.C. 154(b) by 0 days.

(21) Appl. No.: 09/344,021

(22) Filed: Jun. 25, 1999

Related U.S. Application Data

(63) Continuation of application No. PCT/EP98/06774, filed on Oct. 24, 1998.

(30) Foreign Application Priority Data

Oct. 27, 1997 (DE) ..... 197 47 329

(51) Int. Cl.[7] ..... B65H 16/06

(52) U.S. Cl. ..... 242/598.3; 242/533.2; 66/151

(58) Field of Search ..... 242/598.3, 533.2, 242/542.3, 598.4; 66/151

(56) References Cited

U.S. PATENT DOCUMENTS

| | | | |
|---|---|---|---|
| 4,934,413 | 6/1990 | Yao | 139/1 R |
| 5,102,238 | 4/1992 | Contzen | 384/263 |
| 5,211,036 * | 5/1993 | Engelfried et al. | 242/533.2 |

FOREIGN PATENT DOCUMENTS

| | | |
|---|---|---|
| 1 256 503 | 10/1963 | (DE) . |
| 31 45 405 | 6/1983 | (DE) . |
| 37 18 659 | 8/1988 | (DE) . |
| 41 07 690 | 9/1992 | (DE) . |
| 41 09 888 | 10/1992 | (DE) . |
| 0 360 753 | 3/1990 | (EP) . |
| 0 491 412 | 6/1992 | (EP) . |

* cited by examiner

*Primary Examiner*—John Q. Nguyen
(74) *Attorney, Agent, or Firm*—Barry R. Lipsitz

(57) ABSTRACT

A device for winding webs of fabric into a lap, arranged on a lap rod, with a machine frame, a lap carrier which can move to and from with respect to the machine frame between a winding position and an unloading position and is provided with receiving mechanism for the two ends of the lap rod, which have positioning guides which position the lap rod in the winding position of the lap carrier in a winding rotational position, and with securing elements which secure the lap rod, in the winding position of the lap carrier, against any movement out the positioning guides.

37 Claims, 7 Drawing Sheets

CLOSED

OPEN 10
30
112
106
116
104
122
118
42
114
120
108
102
100
110
38b
OPEN

CLOSED

CLOSE

DEVICE FOR WINDING WEBS OF FABRIC

The present disclosure relates to the subject matter disclosed in PCT Application No. PCT/EP98/06774 of Oct. 24, 1998, the entire specification of which is incorporated herein by reference.

BACKGROUND OF THE INVENTION

The invention relates to a device for winding webs of fabric into a lap, arranged on a lap rod, with a machine frame, a lap carrier which can move to and fro with respect to the machine frame between a winding position and an unloading position and is provided with receiving means for the two ends of the lap rod, which have positioning guides which position the lap rod in the winding position of the lap carrier in a winding rotational position, and with securing elements which secure the lap rod, in the winding position of the lap carrier, against any movement out of the positioning guides.

Such a device is known from German Patent 41 07 690. In the patent, the securing element is designed as a wedge-shaped latching element arranged permanently on the machine frame.

Such a wedge-shaped latching element arranged permanently on the machine frame needs to be adjusted exactly if it is intended to be fully effective, so that achieving perfect security requires a considerable amount of effort to adjust every single device.

In addition, the know device is provided with a closing device which, in the event of operator errors, does not reliably hold the lap carrier in the winding position, with the result that the lap carrier can move independently towards the unloading position and the securing element therefore also becomes ineffective.

The invention is therefore based on the object of improving a device of this generic type such that the lap carrier is reliably secured in the winding position.

SUMMARY OF THE INVENTION

The invention achieves this object in a device of the type described in the introduction in that the securing elements are designed as movable blocking elements which can be moved between a position which secures the lap rod and a position which releases the lap rod, and in that, when the lap carrier is in the winding position, the blocking elements are in the position which secures the lap rod and are fixed in this position.

The advantage of the solution according to the invention can thus been seen in that the securing elements designed as movable blocking elements eliminate the problem of needing to adjust the securing element exactly, because, on account of the mobility provided, the blocking elements are in a position, on the one hand, to secure the lap rod reliably in the position which secures it, and on the other hand, in the position which releases it, to permit the lap rod to move out of the winding position.

The further advantage of the solution according to the invention can be seen in that the movable blocking elements can be fixed by the lap carrier situated in the winding position, so that the movable blocking elements can thus secure the lap rod as desired.

In principle, it is possible to implement fixing of the movable blocking elements by the lap carrier situated in the winding position in different ways. For example, it would be conceivable to allow the lap carrier to act on the movable blocking elements directly or by means of an intermediate element in order to fix them.

However, a particularly expedient solution, in design terms, provides that, in the winding position, the movable blocking elements are fixed in the position which secures the lap rod by the receiving means acting on the said blocking elements. The advantage of this solution lies in the simplicity of its design and also in the fact that the movable blocking elements have in any case to be arranged near to the receiving means in order to fix the lap rod in the winding position, so that, to fix movable blocking elements, use is expediently made of the receiving means which are situated near to them in any case.

In order for it to be a simple matter to allow the movable blocking elements to pass into the position which releases the lap rod, the invention preferably provides that the blocking elements release the lap rod while the lap carrier is moving from the winding position into the unloading position, the movement of the lap carrier, in particular, towards the unloading position also causing the receiving means to release the movable blocking elements fixed in the winding position.

The positioning guides for the lap rod, contained by the receiving means, can be of different design in principle. One particularly advantageous solution provides that the positioning guides are designed such that the ends of the lap rod are positioned in the winding rotational position on account of the gravitational force acting on the lap in the winding position. A particularly simple and cost-effective embodiment of such positioning guides provides that they have guide faces for the lap rod which are arranged in a U- or V- or semicircular shape with respect to one another.

As regards the action of the blocking elements specifically, no further details have hitherto been given. Hence, one advantageous exemplary embodiment provides that the movable blocking elements secure the lap rod against moving out of the receiving means, that is to say that the receiving means are designed such that the lap rod can move out of them, whether as a result of a movement along a rising slope or of lifting out, and that all these movements are prevented by the blocking elements.

In this context, it is particularly expedient if the blocking elements secure the lap rod against moving out of the positioning guides of the receiving means. This means that the blocking elements not only prevent the lap rod from leaving the receiving means taken as a whole, but that the blocking elements even prevent movement out of the positioning guides of the receiving means, that is to say movement into other sections of the receiving means which are not covered by the positioning guides. This ensures that the positioning guides always position the lap rod in the winding position exactly, and also that the lap rod does not leave the exact position predetermined by the positioning guides.

With the solution according to the invention, it is in principle conceivable for the lap carrier to move from the winding position into the unloading position in any desired manner. For example, it would be conceivable to have a translational movement, or alternatively a translational movement combined with a rotational movement. A particularly simple and expedient solution provides that the lap carrier can pivot about a pivot axis, and in that the lap rod held in the receiving means can move along a circular path between the winding position and the unloading positioning. The simplicity of design and also the simple operability of this solution mean that is has considerable advantages over the other solutions mentioned above.

In the context of the explanation of the previous exemplary embodiments of the solution according to the invention, the receiving means have not been defined in any more detail; they were merely defined as having positioning guides for the lap rod. In order, in particular, to fix a defined movement for the lap arranged on the lap rod during unloading, and particularly to ensure that the lap does not fall out of the lap carrier in an uncontrolled manner, the invention preferably provides that the receiving means have guide paths which adjoin the positioning guides in an unloading direction and along which the lap rod can move when changing from the winding position into the unloading position. The solution has the advantage that the guide paths may be designed such that the lap rod moves, together with the lap arranged on it, in a controlled fashion along the guide paths and can thus also be transferred into a transport device in a controlled fashion, for example.

It would, in principle, be conceivable to design these receiving means such that moving the lap rod along the guide paths requires the action of the additional force on the lap or the lap rod. A particularly advantageous solution provides that the lap rod follows the guide paths in a direction leading ways from the positioning guides on account of the gravitational force acting on the said lap carrier when the lap carrier changes from the winding position into the unloading position. That is to say that an operator merely needs to transfer the lap carrier from the winding position into the unloading position, and hence, inevitably guided by the guide paths and initiated by the action of the gravitational force, the lap rod with the lap moves along the guide paths and moves out of the positioning guides into a desired position on the basis of the shape of the guide paths.

In this context, it is particularly advantageous if the guide paths are designed such that the lap rod which follows them can move out of the lap carrier in the unloading position, that is to say independently leaves the receiving means and thus also the lap carrier owing to the action of the gravitational force.

As regards the ability of the vlocking elements to move, no further details have been given in connection with the previous explanation of the individual exemplary embodiments. Thus, in principle, it would be possible for any kind of mobility of the blocking elements to execute, if the shape of the latter were adapted accordingly, a movement between a position which releases the lap rod and a position which secures the lap rod. One solution which has particularly simple design and is also advantageous in terms of the way it works provides that the blocking elements can move, by means of a tilting movement, from the position which secures the lap rod into the position which releases the lap rod, and vice versa, a tilting movement having the advantage that it can be produced in a freely running manner and with low wear.

The blocking elements would in this case be able to tilt about a tilting axis arranged in any desired manner, and to move translationally as well, for example. One particularly advantageous solution provides that the blocking elements can pivot about a tilting axis which passes through the blocking elements, so that the solution provides a particularly compact design, in particular.

Particularly advantageous kinematics are produced during the movement of the blocking elements if the tilting axis is arranged on a side, opposite the pivot axis, of the trajectory through which the lap rod runs during the movement from the unloading position into the winding position.

In addition, the kinematics of the tilting movement of the blocking elements become particularly advantageous if the tilting axis is arranged on a side, opposite the pivot axis, of a vertical passing through the lap rod in the winding position, because in this case the blocking elements and the tilting axis can be arranged compactly with reliably working kinematics.

As regards the design of the blocking elements themselves, no further details have been given in connection with the previously described solution according to the invention. In principle, the blocking elements could be designed in any desired manner—provided that they fulfil the function mentioned in the introduction.

The invention preferably provides that the blocking elements have a blocking face with extends at a distance from the guide faces of the positioning guide and so as to overlap an open side defined by the latter.

It is particularly advantageous in this context if the blocking faces extend, in their position which secures the lap rod, transversely with respect to the guide faces of the positioning guides located in the winding position.

If has been found to be advantageous, in design terms, if the blocking faces, in their position which secures the lap rod, act on the lap rod on the side opposite the positioning guide and thus prevent movement out of the positioning guide.

In addition, in the context of the previous explanation of the shape of the blocking elements according to the invention, there has been no discussion of what the preferable extent of the tilting movement of the blocking elements should be in order to be advantageous. It is particularly advantageous in this context if the blocking elements can be tilted out of the position securing the lap rod to such an extent that the blocking face, in its position which releases the lap rod, extends approximately parallel to the trajectory of the lap rod near to the winding position, so that the possibility exists, on the one hand, of orienting the blocking face to be so transverse to the guide faces of the positioning guide in the winding position which movement out of the positioning guides is not possible, but on the other hand, in order for the lap rod to move out of the winding position, the blocking face is then able to be aligned parallel to the trajectory in order to allow the lap rod to pass unimpeded.

In order to ensure that, each movement of the lap carrier with the lap rod from the unloading position into the winding position, it possible for the lap rod to move into the winding position, and the blocking elements then firstly allow the lap rod to pass in a position releasing the lap rod, and then go into the position which secures the lap rod, it would be necessary, for example, when the lap rod moves out of the winding position into the unloading position, for the blocking elements to be fixed in their position which releases the lap rod and moved back into their position which secures the lap rod only when a lap rod has been moved into the winding position. One solution which is simpler still provides that the blocking elements have run-in angles which extend transversely with respect to the trajectory of the lap rod, run away from the blocking face at an increasing distance from the trajectory, and ensure that a lap rod moved from the unloading position into the winding position firstly, as a result of running up against the run-in angles, moves the blocking elements into the position releasing the lap rod and enables the latter to reach the winding position; only then do the blocking elements go into their position which secures the lap rod. This makes it possible, for example, to design the blocking elements to be freely movable in a simple manner, and to prevent the blocking elements from being able to move only when a lap rod is in the winding position and the blocking elements are intended to remain in their position which secures the lap rod.

The position of the blocking elements which secures the lap rod can, in principle, be defined by their shape and also, by way of example, by the element which fixes the blocking elements in their position which secures the lap rod and by the position of this element in the winding position. In order to be able to compensate for manufacturing tolerances, however, and thus also to keep the play between the blocking elements in the position which secures the lap rod as low as possible, the invention preferably provides that the position of the blocking elements which secures the lap rod can be fixed by an adjustment element.

Preferably, the adjustment element is in this case designed as an adjustable stop element which is effective for fixing the respective blocking element in the position which secures the lap rod.

As an alternative or in addition to a device for winding webs of fabric corresponding to the features described above, the object according to the invention is also achieved, according to the invention, by a device for winding webs of fabric into a lap, arranged on a lap rod, with a machine frame, a lap carrier which can move to and fro with respect to the machine frame between a winding position and an unloading position and is provided with receiving means for the two ends of the lap rod, which have positioning guides which position the lap rod in the winding position of the lap carrier in a winding rotational position, and with securing elements which secure the lap rod in the winding position of the lap carrier against moving out of the positioning guides, in that a closing device which fixes the lap carrier in the winding position is provided with a locking element which, during the movement of the lap carrier from the unloading position into the winding position, executes a positively actuated closing movement from an open position, which releases a locking element bearing (locking element counterpart), into a closed position, which grasps the locking element bearing.

The advantage of this solution according to the invention can be seen in that the positively actuated control of the closing movement ensures that, when the lap carrier moves into the winding position, the locking element also goes reliably into the closed position and hence the lap carrier is inevitable fixed in the winding position.

The positively actuated control of the closing movement of the locking element can be initiated and executed in a variety of ways. For example, for this purpose, it would be conceivable to provide a lever gear which moves the locking element. A particularly expedient solution, in design terms, provides that the closing movement of the locking element can be initiated by a linkage path and a path follower interacting with the latter, which can move towards one another when the lap carrier moves from the unloading position into the winding position.

In principle, the linkage path and the path follower can be arranged completely separate from the locking element and the locking element bearing.

However, it is particularly advantageous if the linkage path and the path follower are associated with the locking element and the locking element bearing, the association being selectable as desired.

In design terms, a closing device can be designed particularly simply, however, if the locking element bears the linkage path and the locking element bearing forms the path follower, so that the locking element additionally assumes the function of the linkage path, and the locking element bearing additionally assumes the function of the path follower.

In the simplest case, the locking element is designed such that it has a first locking finger engaging behind the locking element bearing, and a second locking finger forming the linkage path.

As regards the possibilities for the locking element to move, no detailed information at all has been given in connection with the previous description of the solution according to the invention. Thus, for example, it would also be possible for the locking element to be designed so as to be linearly movable.

A particularly advantageous solution provides that the locking element can rotate about an axis when moving from the open position into the closed position.

The fact that the locking element can rotate means that the open position and the closed position can easily be designed as the only stable positions of the locking element, so that this ensures that the locking element is only in one of these positions. This can be achieved, for example, in that the locking element is acted upon by an energy-storing device and can always be brought into one of two stable upper dead centre positions by the latter, one of said positions being the open position and the other the closed position.

In addition, when two stable upper dead centre positions are provided, the locking element can be designed such that, immediately before reaching the winding position, the locking element executes a movement, supported by the energy-storing device, into the closed position and is thus "retracted" completely into the winding position.

To ensure further that, in the closed position of the locking element, the locking element does not open independently when any force acts on the lap carrier, the invention preferably provides that the rotating axis of the locking element and the actuation point of the locking element on the locking element bearing are situated on a line which runs approximately parallel to the trajectory of one of the two relative to the other in the region of the winding position.

The locking element can be designed essentially without any force at all if the bolt faces abutting the locking element bearing in the closed position extend transverse, preferably vertical, on the trajectory.

Since—as already explained in the introduction—the lap carrier is intended to be positioned in the winding position as exactly as possible in order to achieve satisfactory interaction between the receiving means and the securing element, the invention preferably provides that, in the closed position, the locking element fixes the winding position of the lap carrier relative to the machine frame.

To this end, the invention preferably provides that, in the closed position, the locking element engages around the locking element bearing such that the locking element and the locking element bearing are prevented from the relative movement towards the winding position and towards the unloading position.

This can be achieved particularly easily in that the locking element has two bolt faces which adjoin opposite sides of the locking element bearing.

In this case, the locking element is preferably designed such that it has two locking fingers with locking finger faces which point towards one another and, in the closed position, accommodate the locking element bearing in a positive manner between them in view movement towards the trajectory.

In addition, in order for it to be an easy matter to be able to transfer the closing device according to the invention from the closed position into the open position, the invention preferably provides that the locking element can be brought from the closed position into the open position by means of an operating element provided on the lap carrier.

The operating element is preferably designed as a transverse bar extending over the width of the lap carrier and allowing an operator to actuate the locking element in an ergonomically simple manner.

The locking element can be actuated either directly using the transverse bar or using intermediate elements which act between the latter and the locking element an can have essentially any desired design. It is particularly advantageous if the transverse bar is guided on two operating bars which can be used to actuate the locking elements arranged on both sides.

Other features and advantages of the invention are the subject of the following description and of the drawings, which illustrate an exemplary embodiment.

BRIEF DESCRIPTION OF THE INVENTION

DETAILED DESCRIPTION OF THE INVENTION

Figure 1:
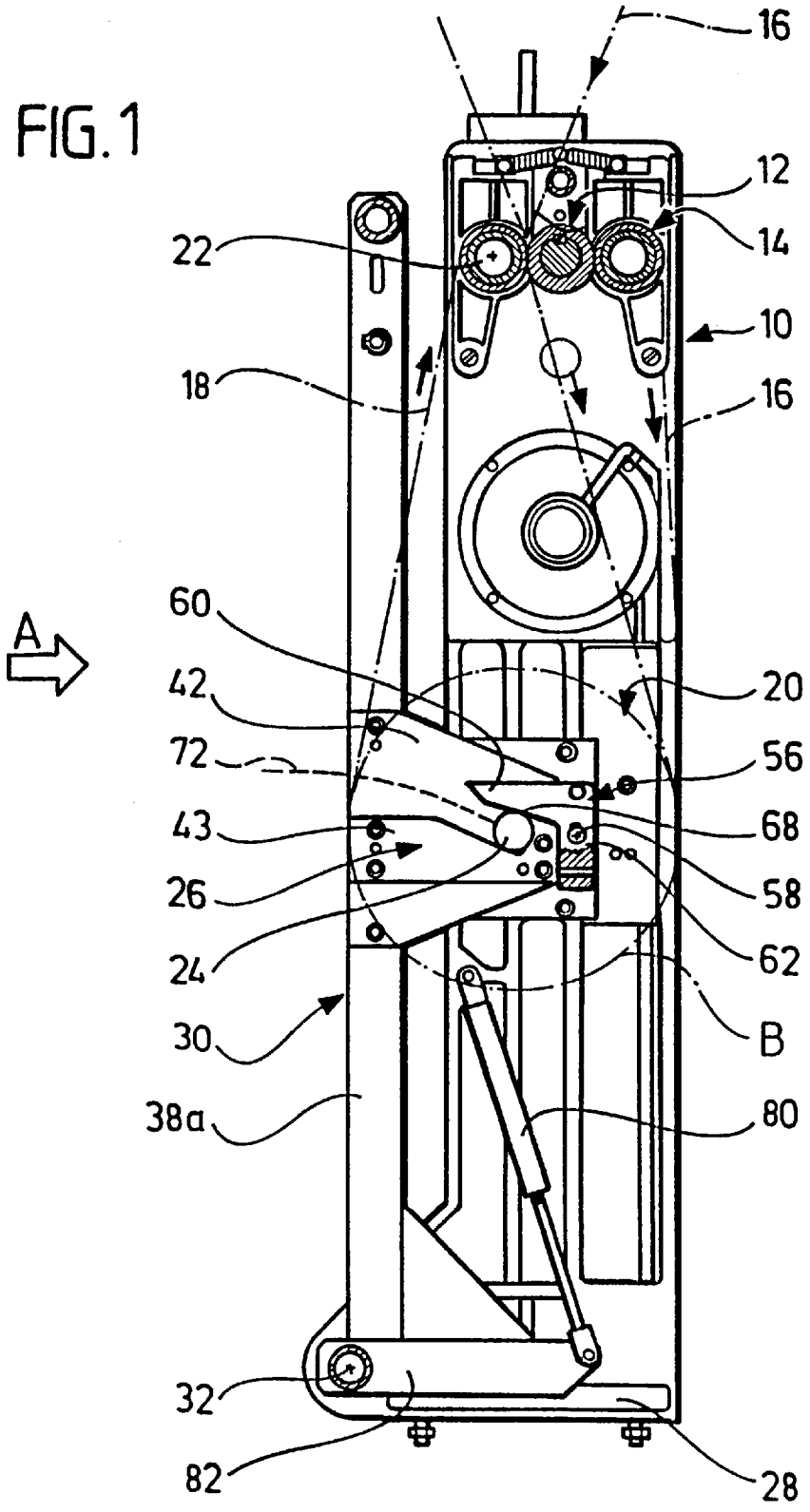
FIG. 1 shows a diagrammatic illustration of a vertical longitudinal section through a device according to the invention when the lap carrier is in the winding position.
Figure 2:
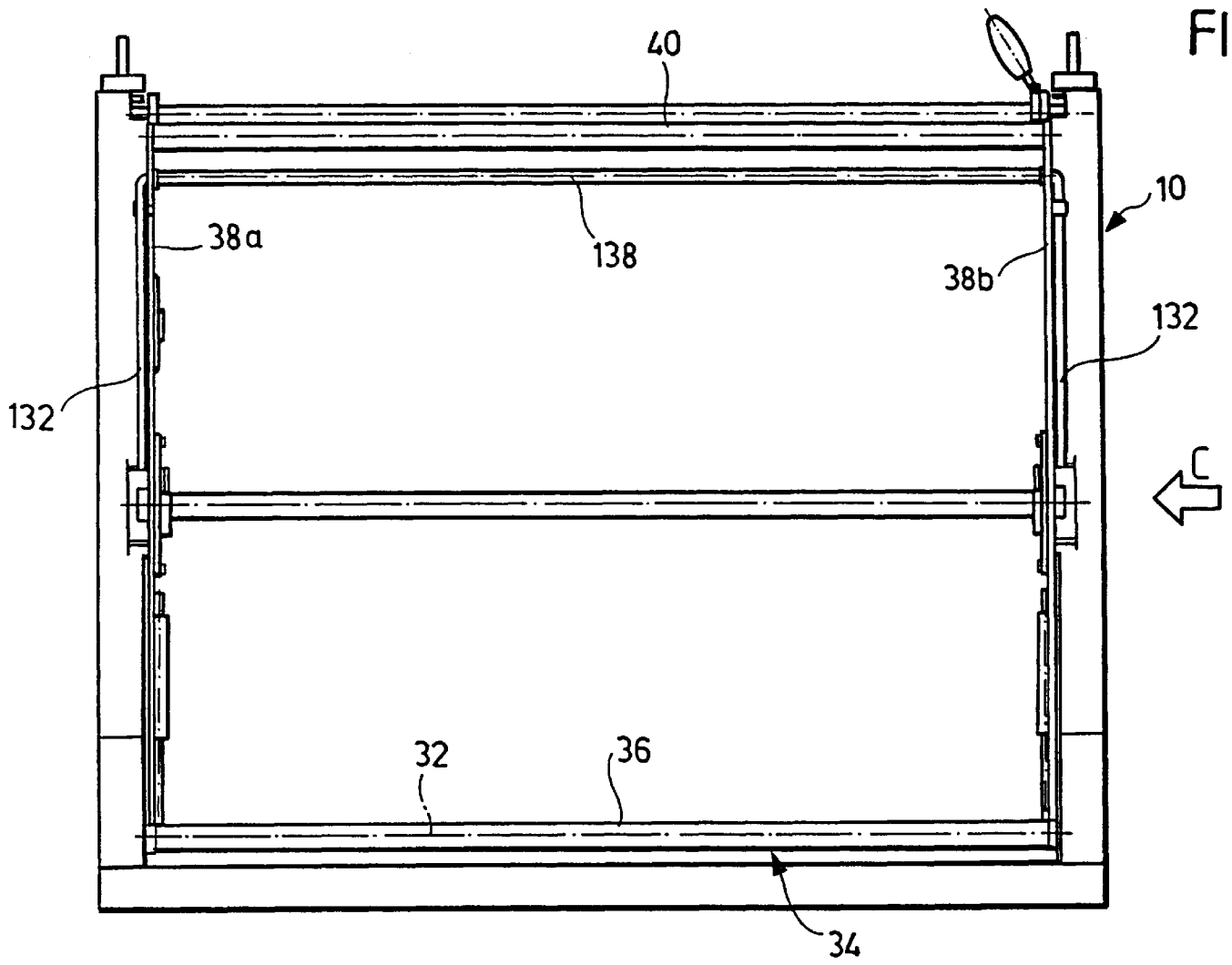
FIG. 2 shows a view of the device in the direction of arrow A in FIG. 1.

An exemplary embodiment of a device according to the invention for winding webs of fabric, illustrated in FIGS. 1 and 2, comprises a machine frame which is denoted as a whole by 10 and is provided with two take-down rollers 12 and 14 for a web 16 coming from a knitting machine, for example, the said take-down rollers having the web 16 wrapped round them on approximately half a side in each case. The web 16 then runs to a lap, denoted as a whole by 20, wraps around the latter and then runs from the said lap in the form of a loop 18 around a drive roller 22, thereafter returning to the lap 20, so that the web coming from the loop 18 can be wound up into the lap 20, the web 16 lying on the outer side of the latter, passing onto the loop 18 as already described and in so doing partially wrapping around and driving the lap 20.

The lap 20 is wound on a lap rod 24 held in a receiving means 26 of a lap carrier, which is denoted as a whole by 30.

The lap carrier 30, for its part, is mounted in the region of base 28 of the machine frame such that it can pivot, relative to the machine frame 10, about a pivot axis 32 and for this purpose comprises, as FIG. 2 shows, a lap carrier frame 34, formed by a lower crossbeam 36 which is held on the machine frame 10 so as to be able to pivot about this pivot axis 32, two supports 38a, b which extend away from the lower crossbeam 36 and are arranged at a distance from one another as well as at the side of the lap 20 in each case; and an upper crossbeam 40 connecting the support 38a, b to one another.

The supports 38a, b are preferably provided with a supporting plate 42 which has the receiving means 26 arranged on it.

Figure 3:
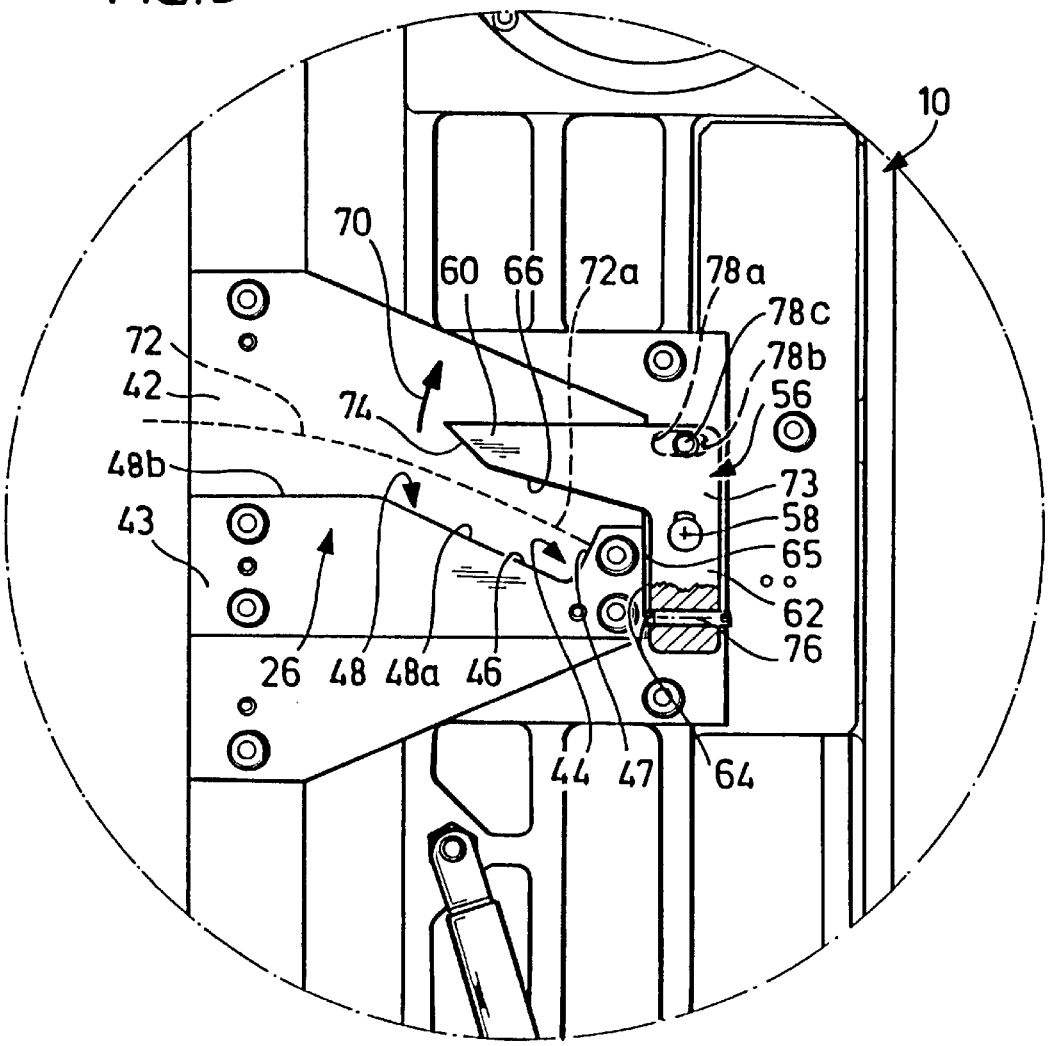
FIG. 3 shows a detailed enlarged view of area B in FIG. 1 without a lap rod.

As FIG. 3 shows in an enlarged view, the receiving means 26 for the lap rod 24 comprises a holding plate 43 which is provided with a positioning guide 44 formed by two guide faces 46 and 47 which run in a V-shape relative to one another and in which the lap rod 24, as shown in FIG. 1, is guided in a winding position of the lap carrier 30 on account of the gravitational force and is thus held in a defined position relative to the lap carrier 30 and, in the winding position of the latter, is also held in a defined position relative to the machine frame 10.

Leading away from the positioning guide 44, its guide face 46 is adjoined by a guide path 48 whose first section 48a is inclined towards the positioning guide 44 in the winding position so that it thus moves the lap rod to the positioning guide under the action of the gravitational force, and whose second section 48b runs approximately horizontally in the winding position (FIG. 3).

Figure 4:
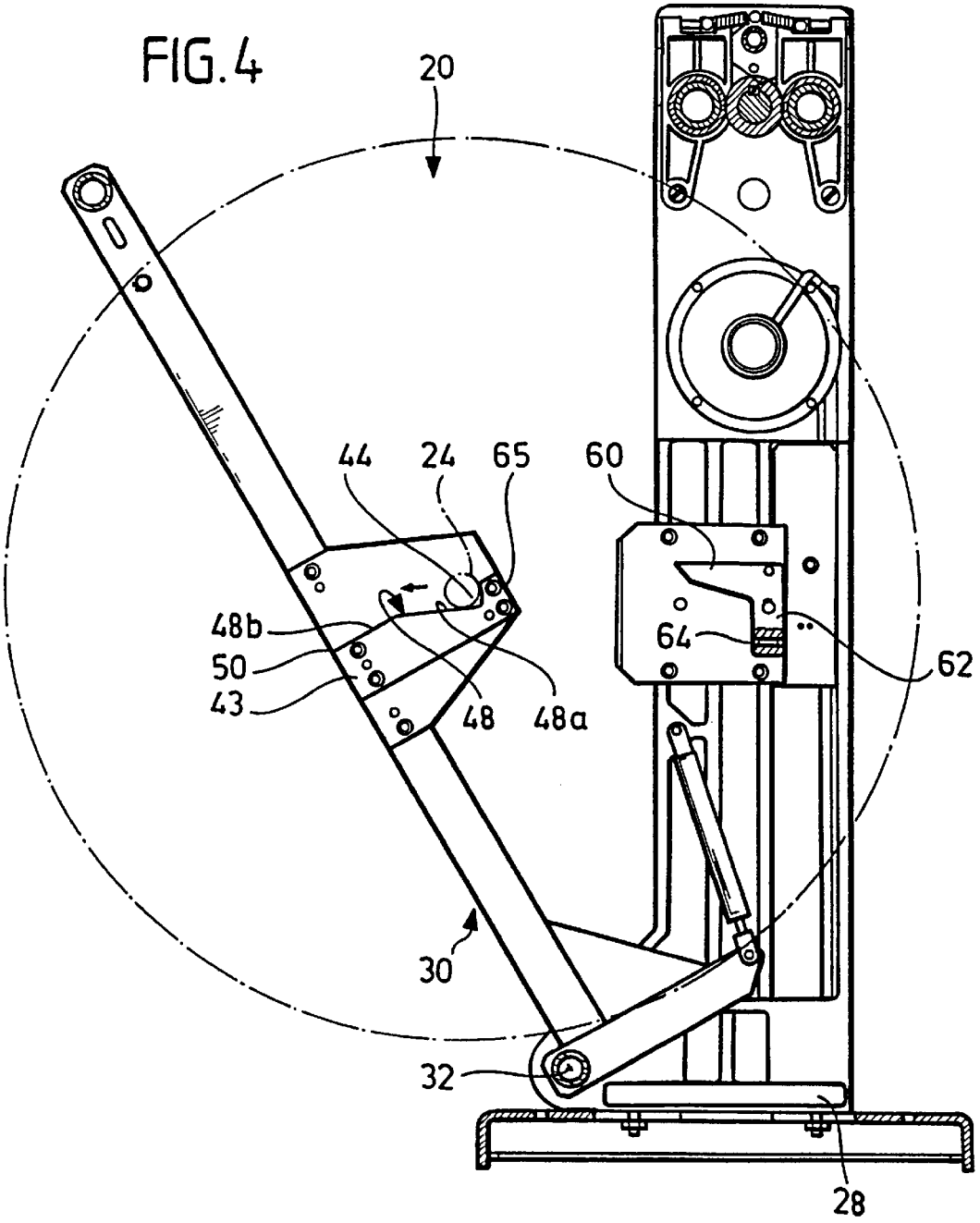
FIG. 4 shows a view of the device similar to FIG. 1 when the lap carrier is in the unloading position.

When the lap carrier is pivoted about the pivot axis 32 from the winding position shown in FIG. 1 into an unloading position shown in FIG. 4, this pivoting action causes both the first section 48a and the second section 48b of the guide path 48 to be inclined downwards away from the positioning guide 44, so that the lap rod 24, under the action of the gravitational force, moves out of the positioning guide 44 along the guide path 48 and leaves the guide path 48 at one end 50, which is arranged on a side of the guide path 48 which is opposite the positioning guide 44, so that the lap 20 together with the lap rod 24 can thus move independently out of the lap carrier 30 under the action of the gravitational force.

To secure the lap rod 24 in the winding position shown in FIG. 1, the machine frame 10 is provided with a blocking element 56 which is denoted as a whole by 56, is designed in the form of a blocking rocker and is mounted on the machine frame so as to be able to tilt about a tilting axis 58.

The blocking element 56 comprises a blocking arm 60 which extends away over an open side of the positioning guide 44 defined by the guide faces 46 and 48 and overlaps the said positioning guide 44, and an operating arm 62 which extends towards the base 28 of the machine frame 10 and adjoins the tilting axis 58. This means that the blocking arm 60 is situated on one side of the tilting axis 58 whilst the operating arm 62 extends on the opposite side of the said tilting axis.

The operating arm 62 has, for its part, an operating face 64 against which one end face 65 of the receiving means 26 acts when it is the winding position, so that the receiving means 26 situated in the winding position fixes the blocking element 56 in its position which secures the lap rod 24 against being released from the positioning guide 44. In this position, guide 44 and is arranged on the blocking arm 60 is in such a position which it acts on a side 68 of the lap rod 24 which is arranged remote from the positioning guide 44 with the guide faces 46 and 47, so that the blocking face 66 holds the lap rod, by acting on its side 68, fixed so as to be situated in the positioning guide 44, without the lap rod 24 having the chance to leave the positioning guide 44, for example by moving along the guide path 48. The blocking face 66 preferably doesnot run parallel, but rather transverse, to the guide faces 46 and 47, expediently in each case at an acute angle with respect to them, and particularly also transverse, expediently at an acute angle, to the section 48a of the guide path 48.

In order to be able to bring the lap carrier 30 together with the lap rod 24 it holds from the winding position shown in FIG. 1 into the unloading position shown in FIG. 4, the blocking element 56 is able to pivot in direction 70 from the position which secures the lap rod 24 in the positioning guide 44, the blocking face 66 being able to move away from the positioning guide 44 in direction 70, specifically to the extent that the end face 65 moves of out the winding position when the pivoting into the unloading position, so that the operating arm 62 is able to follow the latter and can thus permit movement of the blocking face 66 away from the positioning guide 44, the whole blocking element 56 then being capable of pivoting about the pivot axis 58. In this case, the blocking face 66 can be pivoted away from the positioning guide 44 right up to a point where it is situated approximately parallel to a section 72a of a trajectory 72 which adjoins the winding position, the lap rod 24 being able to move out of the winding position along the said trajectory when the lap carrier 30 pivots about the pivot axis 32.

In this case, the tilting axis 58 is preferably situated in a region between the operating arm 62 and the blocking arm 66 of the blocking element 56, preferably in a central piece 73 of the blocking element 56, specifically at approximately the same height above the base 28 as the lap rod 24 situated in the winding position.

In order to be able to move back the lap carrier 30, with a lap rod 24 inserted into the positioning guide 44 in each case, from the unloading position into the winding position and at the same time to make the blocking element 56, which is preferably always moving into the securing position, also tilt about the tilting axis 58 for running into the winding position, the blocking arm 60 is additionally provided with a run-in angle 74 which runs in the direction of the blocking face 66 but is inclined with respect to it such that, when the run-in angle 74 is contacted by the lap rod 24 moving along the trajectory 72, the blocking arm 60 is lifted up and the lap rod 24 is able to move underneath the blocking face 66. The blocking arm 60 is able to continue to tilt in the way—as already described—for as long as the end face 65 is not acting on the operating arm 62 and tilting the blocking element 56 about the tilting axis 58 to counter to direction 70 again, which caused the blocking face 66 to act in turn on the lap rod 24, specifically on its side 68, in order to keep the lap rod 24 in the positioning guide 44.

To adjust a movement of the blocking arm 60 in accordance with the movement of the end face 65 in the direction of the operating arm 62, the operating arm 62 is also provided with a setting screw 76 which passes through it, bears the operating face 64, can be adjusted relative to the end face 65 in the winding position and thus makes it possible to adjust the movement of the blocking arm 60 ion relation to the movement of the blocking face 65, it being possible, in particular, to adjust interaction of the same. In addition, to limit the tilting movement of the blocking element 56 about the tilting axis 58, a stop acting between the blocking element 56 and the machine frame 10 is also provided which used a stop pin 78c which can move between two stop surfaced 78a, b to limit the tilting movement of the blocking element 56 to an angular range of less that about 10°.

In addition, the blocking element 56 is designed such that the action of the gravitational force, in particular its action on the blocking arm 60, means that the blocking element 56 is automatically always in its position which secures the lap rod 24, and leaves this position only when a lap rod 24 is moved from the unloading position into the winding position or vice versa. However, the blocking element 56 can continue to move freely about the tilting axis 58 as long as the lap carrier 30 is not in the winding position and acting with the end face 65 on the operating arm 62 via the operating surface 64 of the setting screw 76, this securing the lap rod 24 situated in the positioning guide 44, particularly in the winding position, against moving out of the positioning guide 44.

In order, furthermore, to compensate for mass when moving the lap carrier 30 with a heavy lap 20, such as is shown in FIG. 4, from the winding position into the unloading position, and particularly to limit the tilting moment acting on the lap carrier as a result of the gravitational force of the lap 20, the invention preferably provides a gas pressure spring 80 which on the one hand acts on a lower arm 82 extending from the pivoting axis 32, for example transverse to the supports 38a, b, and on the other hand acts on the machine frame 10, is tensioned when the lap carrier 30 moves from the winding position into the unloading position, and, as a result, produces a torque acting in the direction of the winding position in order to compensate for the tilting movement produced by the gravitational force.

Figure 5:
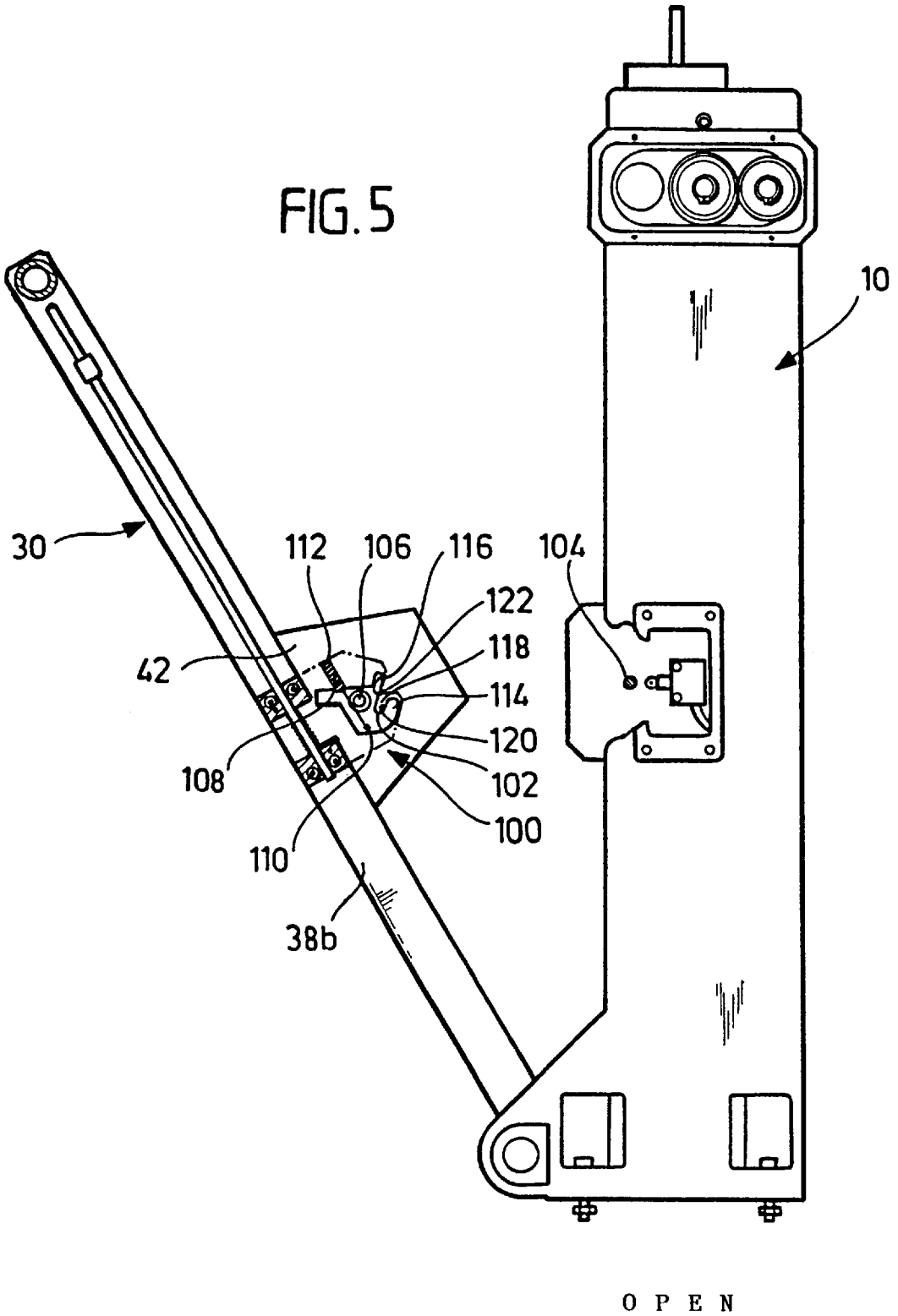
FIG. 5 shows a side view in the direction of arrow C in FIG. 2 with a detailed illustration of the closing device in the unloading position and the open position of a locking element.
Figure 6:
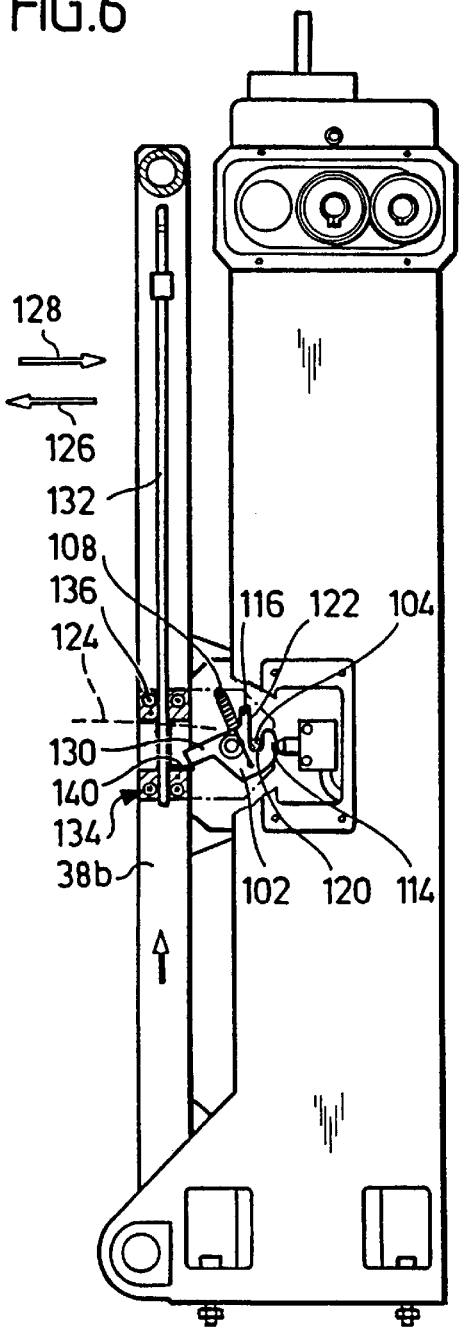
FIG. 6 shows a view of the closing device similar to FIG. 5 in a winding position and the closed position of the locking element.

In order, furthermore, to be able to fix the lap carrier 30 reliably in the winding position relative to the machine frame, the supporting plates 42 connected to the supports 38 have a closing device, denoted as a whole by 100, in each case arranged on a side which is remote from the receiving means 26, and this closing device has a locking element 102 which interacts with a lock thrust bearing 104 which is arranged permanently on the machine frame 10, FIG. 5 showing an open position and FIG. 6 showing a closed position of the locking element 102.

The locking element 102 can rotate about a bolt axis 106 between the open position, shown in FIG. 5, and the closed position, shown in FIG. 6, and is acted upon by an elastic energy-storing device 108 which acts on the locking element 102 in such a way that the said locking element is stable in only two rotational positions defined by stops, these positions being two upper dead centre positions.

By way of example, the elastic energy-storing device 108 acts with a tensioning force on the locking element 102 on the actuation point 110 arranged in each of the upper dead centre positions on one side of the rotating axis 106, and is on the other hand held by a support point 112 on the supporting plate 42, the support point 112 being situated on a side of the rotating axis 106 which is opposite the actuation point 110. The elastic energy-storing device 108, for example designed as a tension spring, thus has the purpose of continuously shortening the distance between the support point 112 and the actuation point 110, a dead centre being present during the movement of the locking element 102 from the open position into the closed position if the connecting line between the actuation point 110 and the support point 112 intersects the rotating axis 106 and has maximum length. Hence, this dead centre position is unstable and the elastic energy-storing device has a tendency to move the locking element 102 continuously in such a way that the connecting line between the actuation point 110 and the support point 112 is shortened and is situated either on one or the other side next to the rotating axis 106.

To fix the lap carrier 30 in the winding position, the locking element 102 is provided with two locking fingers 114 and 116 arranged at a distance from one another and between which is U-shaped free space 118 remains into which a spigot acting as a locking element bearing 104 can be moved during movement into the winding position, the first finger 114 engaging behind the spigot 104 on a side remote from the lap carrier 30 whilst the second locking finger 116, as shown in FIG. 6, adjoins a side of the spigot 104 which points to the lap carrier 30, which means the spigot 104 is held in positive fashion between the two locking fingers 114 and 116 when they are in the closed position.

The locking fingers 114 and 116 are preferably provided with locking finger faces 120 and 122 which point to the spigot and which, in the closed position of the locking element 102, are situated transverse to a trajectory 124 which described the rotating axis 106 of the locking element 102 about the pivot axis 32 during movement out of the winding position, preferably approximately perpendicular to the latter, the locking element bearing 104, in particular, also being arranged near to the trajectory 124, or better still on it. Hence, in the winding position, the forces transmitted from the bolt receiving means 104 to the locking fingers 114 and 116 produce no significant torque, during movement in a direction 126 out of the winding position or a direction 128 towards the winding position, on the locking element 102, and hence this bolt can be held continuously in its closed position by the energy-storing device 108 alone.

To transfer the locking element 102 from the closed position, shown in FIG. 6, into the open position, shown in FIG. 5, the locking element 102 is also provided with an operating finger 130 extending in the direction of the respective support 38a, b.

This support 38a, b can have an operating bar 132 guided on it such that is can be displaced in the longitudinal direction of the respective support 38a, b; preferably by means of roller sets 134 and 136 arranged at a distance from one another, and this operating bar 132 can thus move in the longitudinal direction of the respective support 38a, b.

Each of these operating bars 132 leads to a transverse bar 138, illustrated in FIG. 2, which runs, in an initial position, at a distance from the crossbeam 40 and can move towards the transverse bar 138 to actuate the locking element 102.

Each of the operating bars 132 is provided with a lug 140 which interacts with the corresponding operating finger 130 and, when the transverse bar 138 moves from the initial position towards the crossbeam 40, causes the locking element 102 to pass from its closed position, as an upper dead centre position fixed by the energy-storing device 108, beyond the dead centre into its open position, as the other upper dead centre position fixed by the energy-storing device 108, and to remain in a stable position in this position.

In this open position, the possibility now exists of moving the lap carrier 30 from the winding position into the unloading position.

Figure 7:
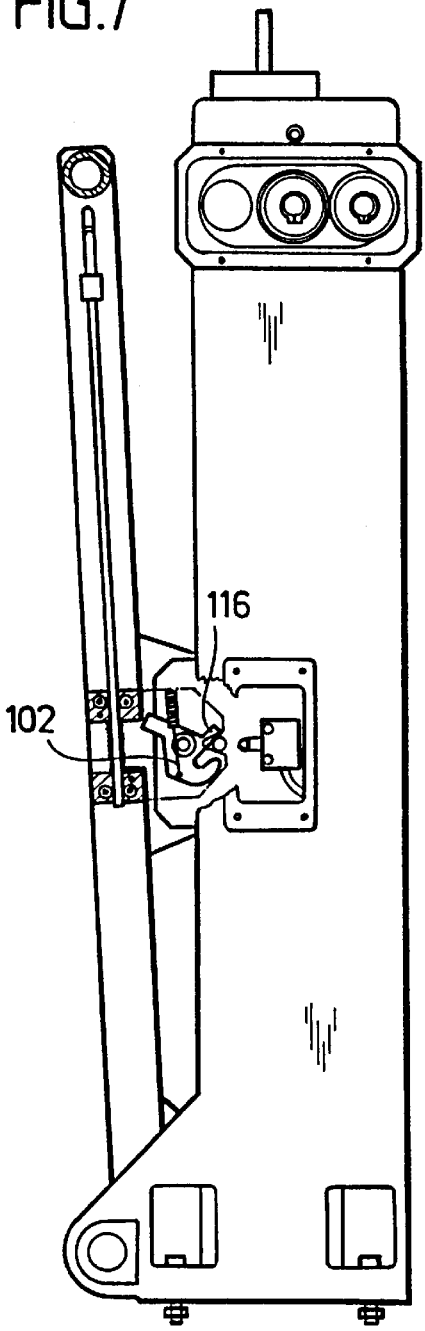
FIG. 7 shows a view similar to FIG. 6 immediately before the locking element moves from the open position into the closed position.
Figure 8:
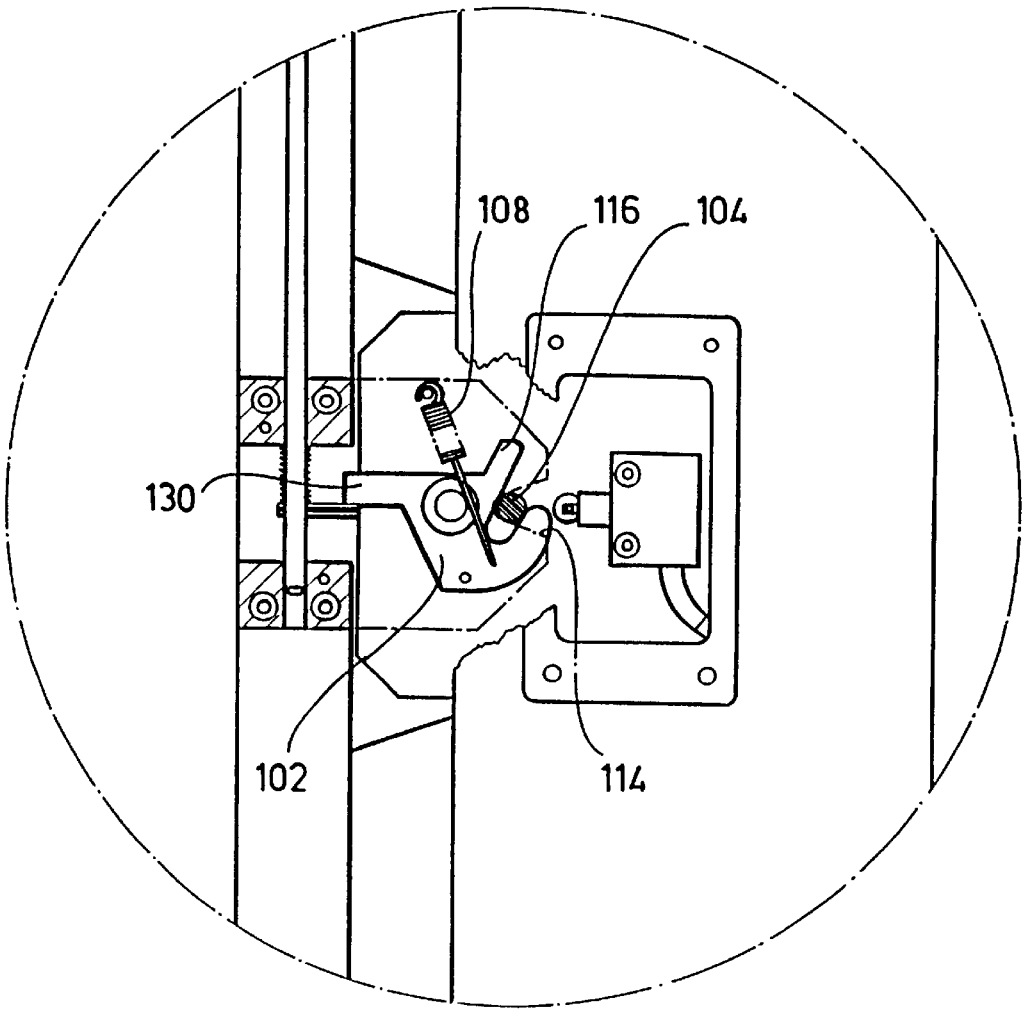
FIG. 8 shows an enlarged view of the closing device during a change from the closed position into the open position.

When the lap carrier 30 moves back from the unloading position into the winding position, the locking element 102 firstly remains, as before, in its open position until, as shown in FIG. 7, the locking element bearing 104 (locking element counterpart) comes to rest on the locking finger face 122, acting as a linkage path, of the second locking finger 116, which is of elongate design in comparison to the first locking finer 114, and, during further movement in the direction of the winding position, presses against the said locking finger face 122 whilst the first locking finger 114, on account of the fact that it is designed to be shorter than the second locking finger 116, can move past the bolt bearing and engage behind this bearing. The result of this is that the locking element 102, starting from the open position, is forcibly moved counter to the action of the energy-storing device 108 in the direction of its dead centre position and beyond this towards the closed position, as a result of which the first locking finger 114 then also begins to engage behind the locking element bearing 104, and finally, the action of the energy-storing device 108 causes the locking element 102 to move automatically into its closed position, and during this movement into the closed position, the the energy-storing device 108 also causes so-called "retraction" of the locking element 102 into the winding position and ultimately holds the lap carrier 30 fixed in the winding position until released again by means of the transverse bar 138 and the operating finger 130, in which case, as shown in an enlarged view in FIG. 8, the first locking finger 114 withdraws from engagement behind the locking element bearing 104, and the second locking finger 116 acts with the locking finger face 122 against the locking element bearing 104 and thus causes the entire lap carrier 30 to move out of the winding position, with support on the locking element bearing 104, so that an operator need merely restart the pivoting movement of the lap carrier 30 from the winding position into the unloading position on the crossbeam 40.

To ensure that, in the winding position, the locking element 102 has reached its closed position, the invention preferably provides an end switch 120 which detects whether the first locking finger 114 is engaged behind the locking element bearing 104 in the same way as for the closed position of the locking element 102.

What is claimed is:

1. A device for winding webs of fabric into a lap arranged on a lap rod, comprising:

a machine frame, a lap carrier associated with the machine frame which can move toward and away from the machine frame between a winding position and an unloading position respectively and is provided with receiving means for two ends of the lap rod, said receiving means having positioning guides which position the lap rod in the winding position of the lap carrier in a winding rotational position, and securing elements on the machine frame which secure the lap rod in the winding position of the lap carrier against moving out of the positioning guides, said securing elements comprising movable blocking elements that are movable between a position that secures the lap rod in the receiving means and a position that releases the lap rod, wherein when the lap carrier is in the winding position, the blocking elements are fixed in a position which secures the lap rod.

2. A device according to claim 1, wherein in the winding position, the receiving means is adapted to act on the movable blocking elements to fix them in the position which secures the lap rod.

3. A device according to claim 1, wherein the blocking elements are adapted to release the lap rod while the lap carrier is moving from the winding position into the unloading position.

4. A device according to claim 3, wherein movement of the lap carrier from the winding position towards the unloading position causes the receiving means to release the movable blocking elements fixed in the winding position.

5. A device according to claim 1, wherein the positioning guides are designed such that the ends of the lap rod are positioned in the winding rotational position on account of the gravitational force acting on the lap in the winding position.

6. A device according to claim 1, wherein the movable blocking elements secure the lap rod against movement out of the receiving means.

7. A device according to claim 6, wherein the movable blocking elements secure the lap rod against movement out of the positioning guides of the receiving means.

8. A device according to claim 1, wherein:

the lap carrier is pivotable about a pivot axis, and the lap rod held in the receiving means is movable between the winding position and the unloading position along a trajectory comprising a circular path about the pivot axis.

9. A device according to claim 1, wherein the receiving means have guide paths which adjoin the positioning guides in an unloading direction and along which the lap rod is movable when changing from the winding position into the unloading position.

10. A device according to claim 9, wherein the lap rod follows the guide path in a direction leading away from the positioning guides on account of the gravitational force acting on said lap carrier when the lap carrier changes from the winding position into the unloading position.

11. A device according to claim 1, wherein the blocking elements are movable, by means of a tilting movement, from the position which secures the lap rod into the position which releases the lap rod, and vice versa.

12. A device according to claim 11, wherein the blocking elements are pivotable about a tilting axis which passes through the blocking elements.

13. A device according to claim 12, wherein the tilting axis is arranged on a side, opposite a pivot axis of the lap carrier, of the trajectory through which lap rod runs during the movement from the unloading position into the winding position.

14. A device according to claim 1, wherein the blocking elements each have a blocking face which extends at a distance from guide faces of the positioning guides so as to overlap an open side defined by the letter.

15. A device according to claim 14, wherein the blocking faces extend, in their position which secures the lap rod, transversely with respect to the guide faces of the positioning guides located in the winding position.

16. A device according to claim 14, wherein the blocking faces, in the position which secures the lap rod, act on the lap rod on a side opposite the positioning guides.

17. A device according to claim 14, wherein the blocking elements are tiltable, with respect to the position securing the lap rod, to such an extent that the blocking face, in the position which releases the lap rod, extends approximately parallel to the trajectory of the lap rod.

18. A device according to claim 14, wherein the blocking elements have run-in angles which extend transversely with respect to the trajectory of the lap rod and run away from the blocking face at an increasing distance from the trajectory.

19. A device according to claim 1, wherein the position of the blocking elements which secures the lap rod can be fixed by an adjustment element.

20. A device according to claim 19, wherein the adjustment element comprises an adjustable stop element for fixing the respective blocking element in the position which secures the lap rod.

21. A device for winding webs of fabric into a lap arranged on a lap rod, comprising:

a machine frame, a lap carrier which can move toward and away from the machine frame between a winding position and an unloading position and is provided with receiving means for two ends of the lap rod, said receiving means having positioning guides which position the lap rod in the winding position of the lap carrier in a winding rotational position, securing elements which secure the lap rod in the winding position of the lap carrier against moving out of the positioning guides, and a locking device for fixing the lap carrier in the winding position, said locking device being provided with a movable locking element that stays stable in only two positions, one of said stable positions being an open position and the other stable position being a closed position, said locking element being arranged on one of said machine frame and said lap carrier, said moveable locking element being adapted to cooperate with a locking element counterpart arranged on the other of said machine frame and said lap carrier such that said locking element counterpart, during the movement of the lap carrier from the unloading position into the winding position, impacts the movable locking element to cause a physical, positively actuated closing movement which moves said locking element from the stable open position, in which said locking element is released from said locking element counterpart, into the stable closed positioning which the locking element grasps the locking element counterpart.

22. A device according to claim 21, wherein the closing movement of the locking element can be initiated by a linkage path and a path follower interacting with the latter, which can move towards one another when the lap carrier moves from the unloading position into the winding position.

23. A device according to claim 22, wherein the linkage path and the path follower are associated with the locking element and the locking element counterpart.

24. A device according to claim 23, wherein the locking element bears the linkage path and the locking element counterpart forms the path follower.

25. A device according to claim 24, wherein the locking element has a first locking finger engaging behind the locking element counterpart, and a second locking finger forming the linkage path.

26. A device according to claim 21, wherein the locking element is rotatable about an axis when moving from the open position into the closed position.

27. A device according to claim 26, wherein the rotating axis of the locking element and an actuation point of the locking element on the locking element counterpart are situated on an imaginary line which runs approximately parallel to the trajectory of the two relative to one another in the region of the winding position.

28. A device according to claim 21, wherein the open position and the closed position represent the only stable positions of the locking element.

29. A device according to claim 28, wherein the locking element is acted upon by an energy-storing device and can always be brought into one of two stable upper dead center positions by the latter, one said positions being the open position and the other being the closed position.

30. A device according to claim 29, wherein, immediately before reaching the winding position, the locking element executes a movement, supported by the energy-storing device, into the closed position and thus retracts the lap carrier into the winding position.

31. A device according to claim 21, wherein the locking element is designed such that locking faces abutting the locking element counterpart in the closed position extend transverse on the trajectory of the locking element and the locking element counterpart relative to one another.

32. A device according to claim 21, wherein in the closed position, the locking element fixes the winding position of the lap carrier relative to the machine frame.

33. A device according to claim 32, wherein in the closed position, the locking element engages around the locking element counterpart in a positive manner, so that the locking element and the locking element counterpart are prevented from relative movement towards the winding position and towards the unloading position.

34. A device according to claim 33, wherein the locking element has two locking faces which adjoin opposite sides of the locking element counterpart.

35. A device according to claim 21, further comprising an operating element on said lap carrier for bringing the locking element from the closed position into the open position.

36. A device according to claim 35, wherein the operating element comprises a transverse bar extending over the width of the lap carrier.

37. A device according to claim 36, wherein the transverse bar is guided on two operating bars which can be used to actuate locking elements arranged on both sides thereof.

* * * * *